US006623261B2

(12) United States Patent
Edwards

(10) Patent No.: US 6,623,261 B2
(45) Date of Patent: Sep. 23, 2003

(54) SINGLE-DEGREE-OF-FREEDOM CONTROLLED-CLEARANCE UNIVANE™ FLUID-HANDLING MACHINE

(76) Inventor: Thomas C. Edwards, 1426 Gleneagles Way, Rockledge, FL (US) 32955

( * ) Notice: Subject to any disclaimer, the term of this patent is extended or adjusted under 35 U.S.C. 154(b) by 0 days.

(21) Appl. No.: 09/910,637

(22) Filed: Jul. 21, 2001

(65) Prior Publication Data

US 2003/0021713 A1 Jan. 30, 2003

(51) Int. Cl.[7] ..... F01C 1/344
(52) U.S. Cl. ..... 418/106; 418/107; 418/265
(58) Field of Search ..... 418/106, 107, 418/265

(56) References Cited

U.S. PATENT DOCUMENTS 2,126,279 A * 8/1938 Redfield et al. ..... 418/107
2,243,901 A * 6/1941 Fulcher ..... 418/107
2,672,282 A * 3/1954 Novas ..... 418/265
3,429,228 A * 2/1969 Stoica ..... 418/107
3,528,757 A * 9/1970 Ware ..... 418/107
5,022,842 A * 6/1991 Sakamari et al. ..... 418/265
5,087,183 A 2/1992 Edwards ..... 418/265
5,160,252 A 11/1992 Edwards ..... 418/265
5,374,172 A 12/1994 Edwards ..... 418/265

* cited by examiner

*Primary Examiner*—John J. Vrablik
(74) *Attorney, Agent, or Firm*—Roger W. Jensen

(57) ABSTRACT

A rotary vane apparatus where the rotor has a rotational axis and carries at least one vane which is supported by a vane guide apparatus for rotation about a stator axis which is spaced from the rotor axis a preselected amount and where both the rotor and vane have axial flat surfaces which are rotated adjacent to stationary flat surfaces of a stator or stator endplates, the invention provides axial adjustment of the vane with respect to the flat surface of the stator endplates and independently provides an adjustment of the rotor end surfaces with respect to the stator end surfaces.

11 Claims, 7 Drawing Sheets

48
48'
48AA
70''
80A'
80A
80A''
74
74'

90
92
99
4
91
72
72'
70
70'
5A
XX
80
28''
80''
80'
28
28'

X'X'
80A
29
℄R
70R
70''
74
95
96
93
4

80'
82
80
81

98
97
90AA
99
70
95
96
X
5
5
90
98'
97'

SINGLE-DEGREE-OF-FREEDOM CONTROLLED-CLEARANCE UNIVANE™ FLUID-HANDLING MACHINE

BACKGROUND OF THE INVENTION

This invention relates to the field of vane-type fluid-handling machines, e.g., fluid compressors and expanders. The fluid-handling machine taught by Applicant's U.S. Pat. Nos. 5,087,183 and 5,160,252 (hereinafter the '183 and '252 patents) eliminated the most undesirable spatial degree of freedom of ordinary vane-type compressors by eliminating vane tip rubbing by controlling radial motion of the vane such that its tip cannot contact the stator bore but operate close enough to insure good dynamic fluid sealing. Further, Applicant's U.S. Pat. No. 5,374,172 (hereinafter the '172 patent) teaches a single vane (UniVane™) type fluid-handling machine with, among other features, vane tip radial motion control similar to said '183 and '252 patents. The disclosures of the aforesaid U.S. Pat. Nos. '183, '252, and '172, as well as my co-pending U.S. patent application entitled: "High-Speed UniVane Fluid-Handling Machine", Ser. No. 09/729,505 filed Dec. 4, 2000, are incorporated herein by reference.

Long-duration operation of the UniVane™ compressor, made it clear, however, that in order to achieve exceptional long-term reliability and efficiency, its remaining spatial degree-of-freedom, axial motion, must also be eliminated. Classical mechanics provides that a solid body can have only three degrees of spatial freedom. In cylindrical coordinates, particularly convenient in the present instance, these three degrees of freedom can be represented as: r, z and θ; where r is the radial dimension of the vane tip, z is the axial or longitudinal dimension of both the rotor and stator, and θ is the rotational (operational) dimension of both. Although no specific loads arise in the axial direction in the UniVane™, the running parts nonetheless tend to oscillate or otherwise move axially in actual operation thus causing recurring back-and-forth actual contact and wear between the axial faces of the vane and the rotor as they contact the internal axially-facing static surfaces of the stator.

Further, because leakage is a function of the cube of a leakage gap, when the rotor and valve subassembly moves axially to one side, not only does wear and friction occur on that side, but the leakage gap on the non-contacting, or other end or side doubles. If, for example the free, or designed axial clearance, were 0.001" (0.025 mm) per side, the total leakage doubles when the moving parts shift to one side, even though that side's leakage will be essentially zero when contacting the static sealing face. Thus, both the rotor and the vane must to be confined to a central location such that they cannot move back and forth axially and contact the endplates of the stator housing. By confining the running parts of the UniVane™ in both the radial and axial directions, the only degree of spatial freedom left is the operational direction of motion of the machine itself: rotational (or θ, as outlined above); the present invention solves the problem and provides the designed axial constraint of both rotor and rotor vane. The invention further permits axial constraint or adjustment of the rotor independent of the vane adjustment, and vice versa.

SUMMARY OF THE INVENTION

The need for precise sealing interface clearance control becomes especially important when a fluid-handling device cannot employ the very significant benefit of a liquid lubrication system. Such a system, through the action of the liquid lubricant, separates the moving parts (and, in effect, controls the clearances) while, simultaneously, provides a liquid leakage barrier between them. For example, a liquid lubrication system cannot be used in compressor applications for supplying air to fuel cells or to medical or food-related systems. Therefore, the highest efficiency and highest reliability fluid-handling mechanism will, by definition, be one in which the operating parts don't engage (rub) but are close enough to provide excellent interface sealing without the benefit of a liquid lubricant. This can be achieved only with fluid-handling mechanisms that possess but a single degree of spatial freedom, i.e., rotational, so the sealing components cannot axially wander about; these desired characteristics are provided by the present invention.

As noted above, the axial motion of both the rotor and the vane of the UniVane™ type fluid-handling machine must be controlled to prevent side contact with the two in-facing stator walls. Because the rotor and the vane rotate about separate (but parallel) axes, they must be controlled independently with the same precision but without mutual interference; the following reveals how such clearance-control is achieved by the present invention.

DETAILED DESCRIPTION OF THE INVENTION

Figure 1:
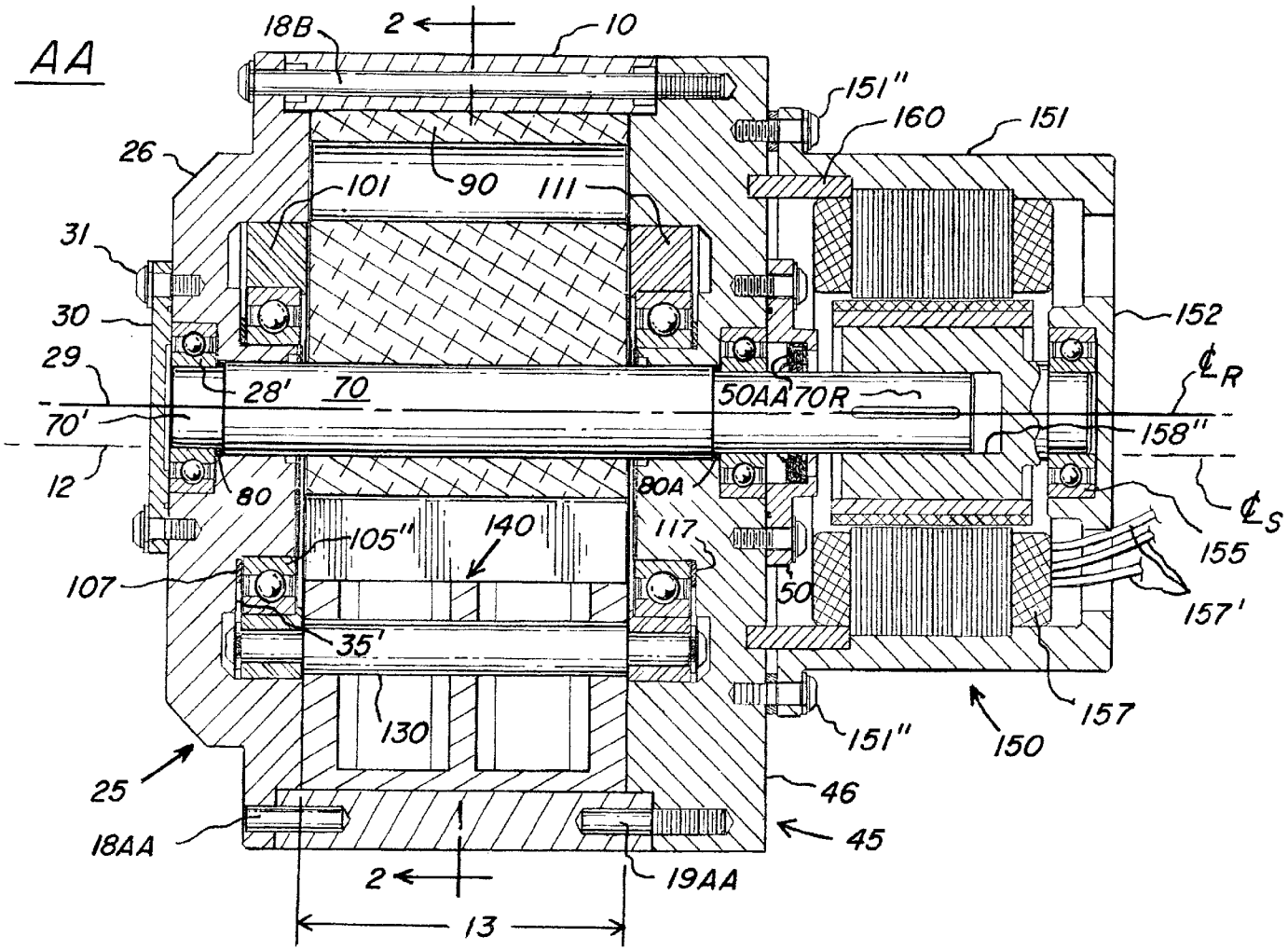
FIG. 1 illustrates a longitudinal cross-sectional view of a single-vane-type machine utilizing the present invention, including an integral electric drive motor, as viewed along section lines 1—1 of FIG. 2.
Figure 2:
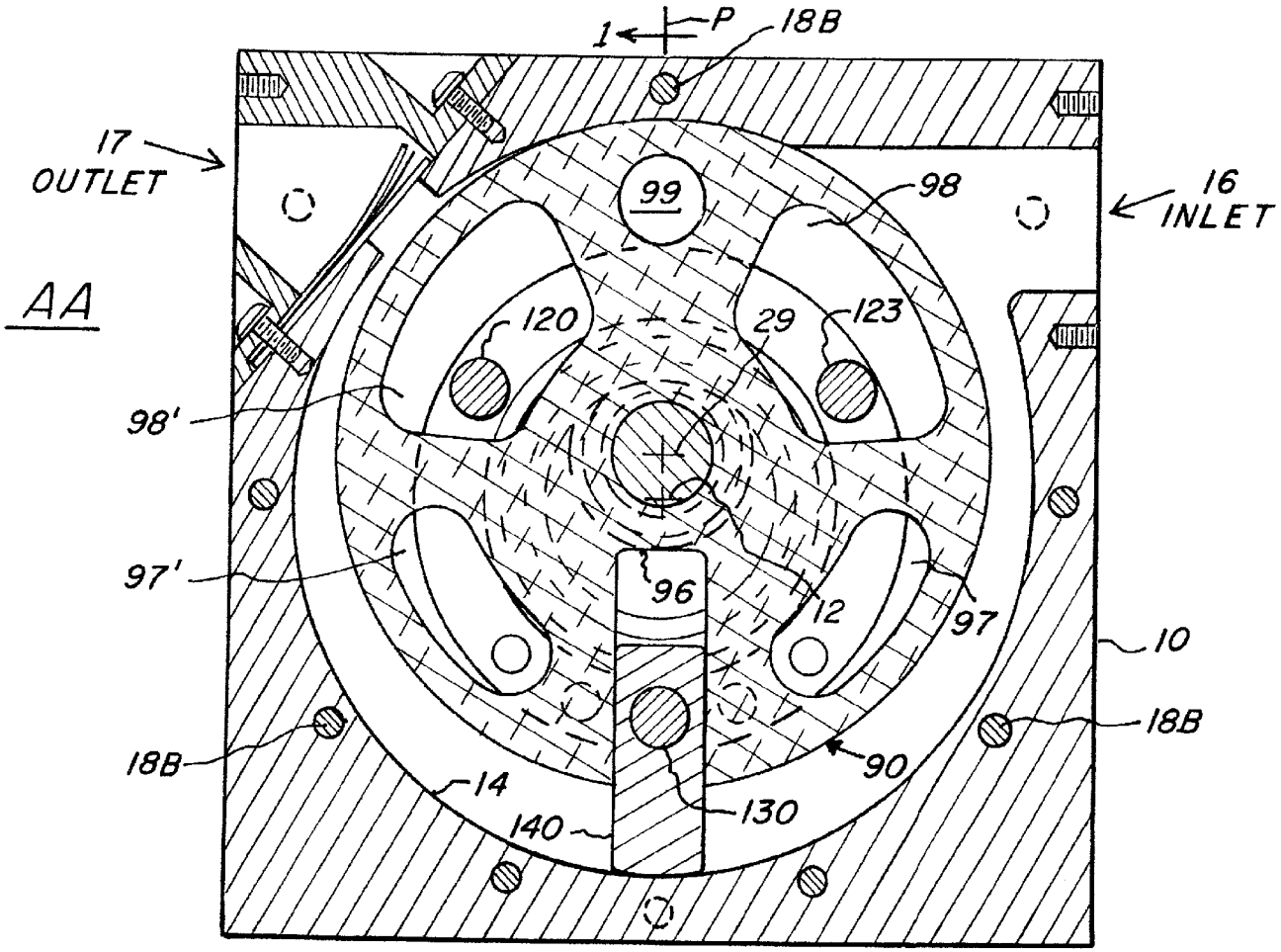
FIG. 2 shows a cross-section of the machine as viewed along section lines 2—2 of FIG. 1.
Figure 3:
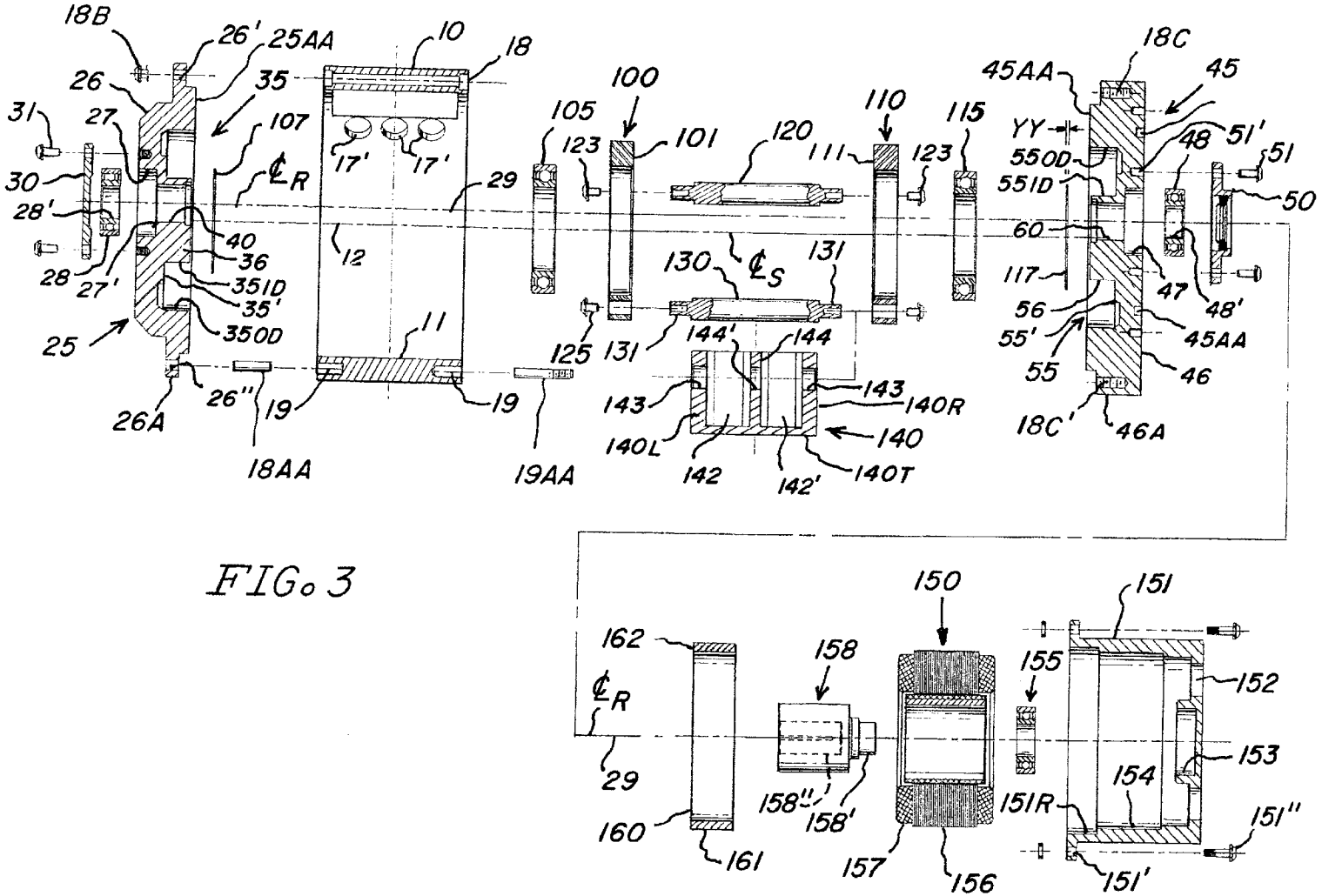
FIG. 3 shows an exploded view of the machine, excluding the rotor, rotor shaft, and rotor axial positioning shims.
Figure 3B:
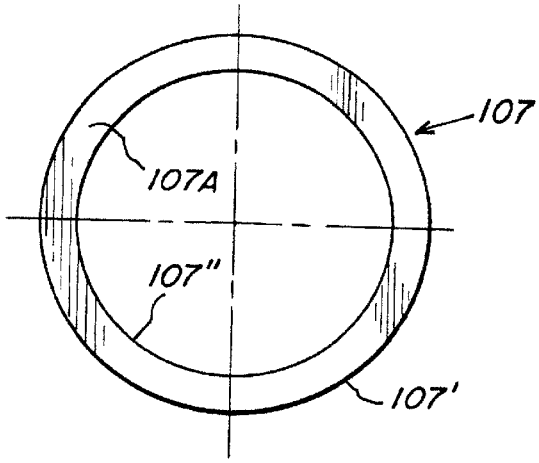
FIG. 3B shows member 107 in plan view, i.e., shows one of the two axial faces or surfaces 107A of member 107.

Referring first to FIGS. 1 and 2, the reference designator AA represents a single vane, or UniVane™ fuel cell compressor comprising a stator housing 10 having a right cylindrical bore 11 therethrough, as is best shown in FIG. 3. Bore 11 has a preselected diameter and a preselected longitudinal axis 12 also identified by the reference $CL_S$. The bore 11 further has a continuous inner surface 14 (see FIG. 2) curved concentrically around said longitudinal axis 12.

First and second stator endplate means 25 and 45 are connectible to the housing 10 at each end thereof so as to define an enclosed right cylindrical space within the housing having a preselected longitudinal length 13 (FIG. 1). The connections of the endplate means includes a plurality of longitudinally extending bores 18 in stator 10 arranged concentrically around the axis 12; a number of concentrically-arranged and axially-aligned bores 26' and threaded recesses 18C are provided in endplate means 25 and endplate means 45, respectively. The assembled end plate means 25 and 45 and stator 10 are held together by a plurality of bolts 18B having threaded right ends, as shown in FIG. 1, screwed into the threaded recesses 18C. The stator housing 10 further includes a pair of opposed longitudinally extending bores or recesses 19 and 19' which are provided for alignment purposes and are adapted to co-act with alignment pins 18AA and 19AA positioned in bore 26" and recess 18C' of endplate means 25 and 45 respectively.

Note, of course that, for example, stator housing 10 and endplate 26 could actually be a single piece of material (and, therefore, endplate 45 would be fastened to the right hand end of 10).

Stator endplate means 25 is further characterized by including, on its outer face, a circular recess 27 for receiving the outer race of a rotor shaft bearing means 28, the inner race of which is identified by reference numeral 28'. Likewise, the endplate means 45 has a circular recess 47 for receiving the outer race of a rotor shaft bearing 48, the inner race of which is identified by reference numeral 48'. The bearings 28 and 48 thus define a rotor shaft rotational axis identified in the drawings both by the designator $CL_R$ (center line rotor), as well as the reference numeral 29. A rotor shaft means 70 (see FIGS. 1, 4, and 5) is supported at its two ends by the inner races, 28' and 48' respectively, of the bearings 28 and 48, and is thus supported for rotation about rotor shaft axis 29 which is parallel to but spaced a preselected distance from the longitudinal axis 12 of housing 10.

A bearing cap retainer means 30 is provided for securing bearing 28 within the recess 27 and is held in place by screw means 31 shown clearly in FIGS. 1 and 3.

Figures 4, 5, 5A, 5B:
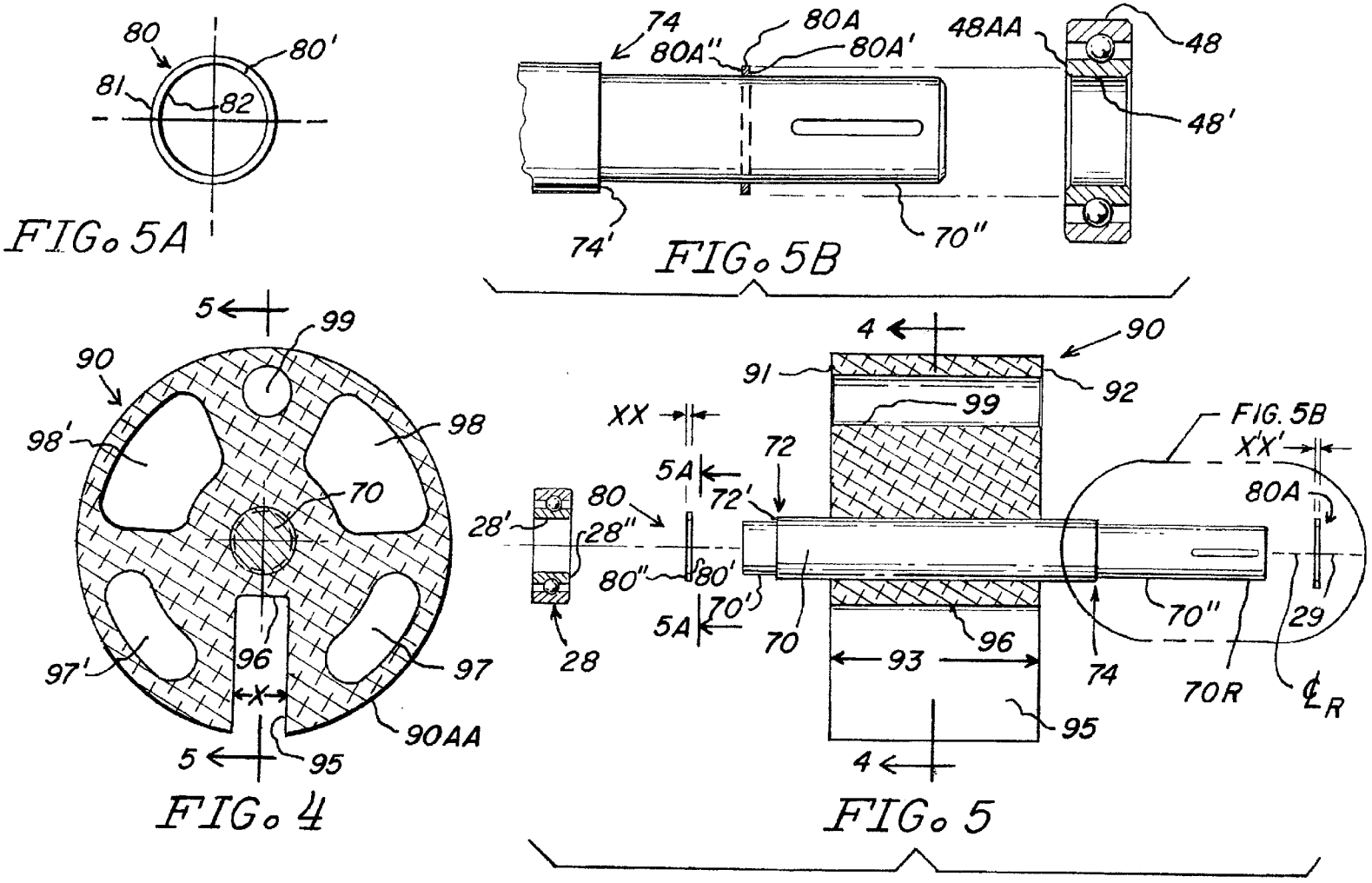
FIG. 4 shows a cross-sectional axial end view of the rotor and rotor shaft as viewed along section lines 4—4 of FIG. 5.
FIG. 5 is an exploded cross-sectional view of the rotor and rotor shaft as viewed along section lines 5—5 of FIG. 4; this view showing, in exploded fashion, the rotor axial adjustment members or shims 80 and 80A, and rotor shaft bearing 28.
FIG. 5A shows a plan or axial end view of one of the axial end faces 80' of the rotor axial positioning shim 80.
FIG. 5B shows an enlarged exploded partial side of the right end of rotor shaft 70 (as viewed in FIG. 5), shim 80A, and rotor shaft bearing 48.

FIG. 5 shows the rotor shaft 70 assembled with the rotor 90, the rotor shaft having a constant or primary diameter for its main extent but with a reduced diameter 70' at the left end thereof as shown in FIG. 5 and a reduced diameter 70" at the right end thereof. Shoulders 72 and 74 are respectively defined by the juncture of reduced diameter portions 70' and 70" with shaft 70; the axial faces of shoulders 72 and 74 are respectively identified by reference numerals 72' and 74'. Rotor end section 70" has greater axial length than that shown for section 70' to facilitate the connection of the rotor shaft to the motor means 150, to be described below. Thus, in FIG. 3, as well as FIG. 1, it is seen that the end 70" of the rotor shaft extends through the rotor bearing 48 and thence through a central opening or a retainer end cap 50 which is connected to the outer face of endplate 45 by threaded screws 51 co-acting with threaded bores 51' in the outer end face 46 of endplate 45. A combined seal and lubrication means 50AA, integral with end cap 50, may be concentrically positioned around shaft portion 70" and retained by the retainer 50 as is clearly shown in FIG. 1.

Also shown in FIG. 5 are a pair of rotor axial adjustment members or shims 80 and 80A shown (in this exploded view) to the left and to the right, respectively, of the ends of shaft 70. One of the shims 80 is shown in plan view in FIG. 5A having an outer diameter 81 and an inner diameter 82. Shim 80 has an outboard axial face 80" and an inner axial face 80', as shown in FIG. 5. The shims 80 and 80A, the bearings 28 and 48, and the shoulders 72' and 74' are all preselected in size so that, when the device is assembled as is shown in FIG. 1, the axial face 80' of shim 80 is abutted against shoulder 72' and the axial face 80" is abutted against the axial end face of the inner race 28" of bearing 28 (see FIG. 5). Likewise, as is shown in larger scale in FIG. 5B, shim 80A has an outboard axial face 80A' adapted to abut against the axial end or face 48AA of the inner race 48' of bearing 48, and the inboard axial face 80A" of shim 80A is adapted to abut against shoulder 74' of the rotor shaft 70.

Referring again to FIG. 5, it will be seen that the axial thickness of shims 80 and 80A are designated by the reference letters XX and X'X' respectively. A key feature of the present invention is to recognize that a careful preselection of the shims 80 and 80A, from the standpoint of axial thickness, will then determine or control the relative axial position of the rotor shaft 70 with its attached rotor 90 with respect to the stationary stator 10, all of which will be explained in more detail below. In the limit, of course, XX or X'X' could be equal to zero.

The first and second stator endplate means 25 and 45 are further characterized by having, on their inner axial faces thereof, annular recesses 35 and 55 respectively, which provide a subhousing for first and second antifriction radial vane guide assemblies to be described below. More specifically, the recesses 35 and 55, respectively, define hubs 36 and 56. The inner and outer circumferential surfaces of annular recesses 35 and 55 are respectively identified by reference numerals 35ID, 55ID, and 35OD, 55OD. Further, the recesses 35 and 55 have "bottom" radially extending surfaces 35' and 55' respectively.

Endplate 25 has a flat inwardly faced, radially extending flat surface 25AA; the corresponding flat surface for endplate means 45 is identified by reference 45AA.

It is important to note that the annular recesses 35 and 55 are concentric with the stator center line 12. Axially extending bores 40 and 60, respectively provided in the endplate means 25 and 45 are preselected to be somewhat larger than the outer diameter of the main section of rotor shaft 70, and are concentric with the rotor axis 29.

Referring to FIG. 5, the rotor 90 has a right cylindrical shape and is mounted on and connected to the rotor shaft means 70 so as to rotate integrally therewith about the rotor shaft axis 29. The rotor 90 has two axial ends 91 and 92 which, as shown, are flat surfaces normal to the rotor shaft axis or, stated otherwise, extend radially from the rotor axis. The rotor further has a longitudinal length 93, shown in FIG. 5, preselected to be substantially the same, but slightly less than, said preselected longitudinal extent 13 of the enclosed space within the bore of housing or stator 10, as shown in FIG. 1. The rotor 90 further comprises a radially extending slot 95 having a preselected slot width X and terminating at the outer periphery 90AA of the rotor, the slot 95 at least in part also extending longitudinally or axially between the two axial ends 91 and 92 of the rotor. The slot 95 extends from the periphery 90AA a preselected distance radially inwardly towards the center of the rotor and terminates with a bottom surface 96, this dimension being preselected so as to accommodate the vane structure to be described below.

As will be understood by those skilled in the art, the rotor 90 may be intended for use in application where it will rotate at a very high speed about its rotational axis, and hence must be dynamically balanced. The required dynamic balance is achieved by having preselected voids 97, 97', 98, 98', and 99 all extending, for example, longitudinally through the rotor as is clearly shown in FIG. 4.

Figure 3A:
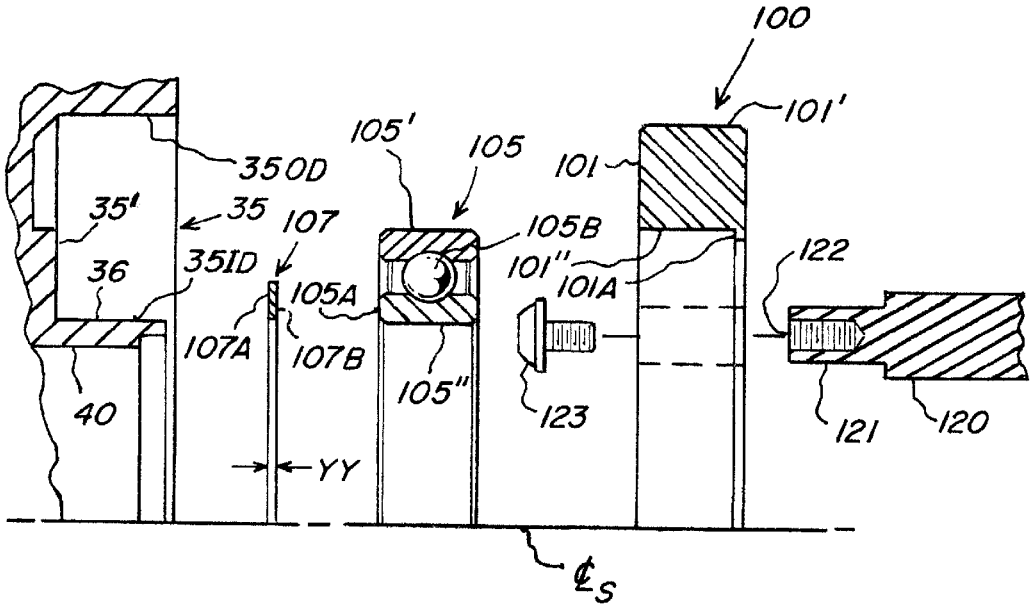
FIG. 3A shows an enlarged exploded partial side view of the anti-friction radial vane guide assembly adapted to be nested in and connected to stator end plate means 35 and vane axial adjustment member or shim 107.
Figure 7:
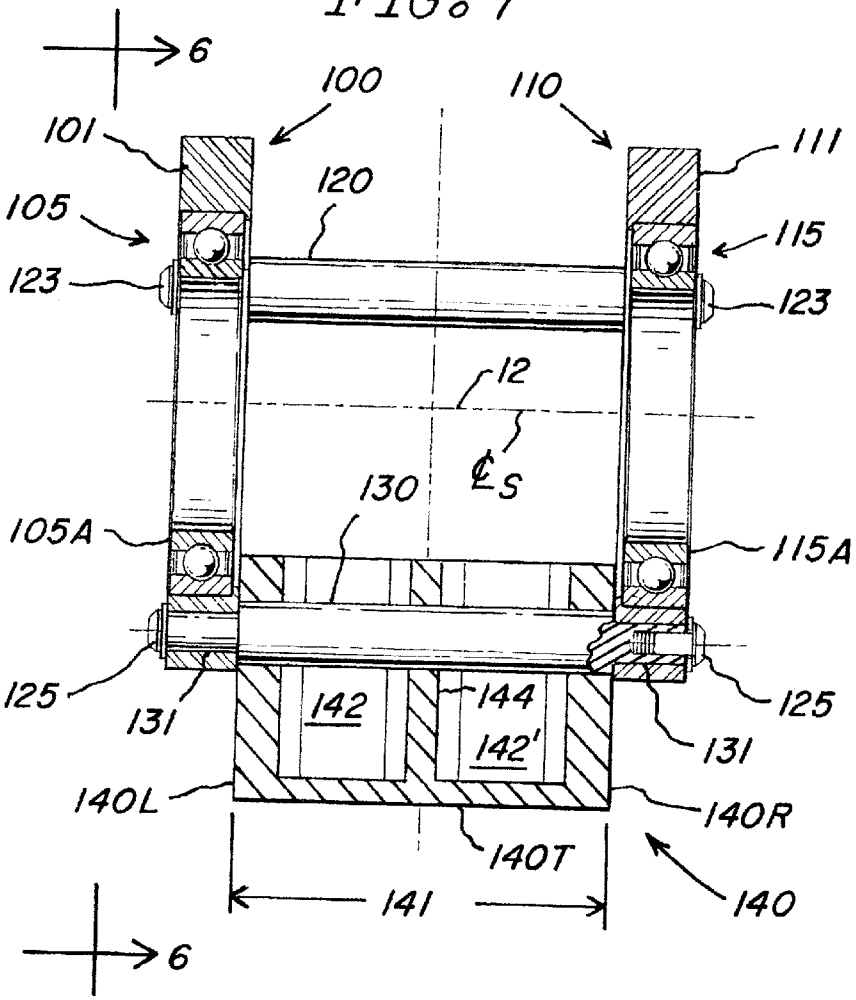
FIG. 7 is a longitudinal cross-section of the apparatus of FIG. 6 as viewed along section line 7—7 of FIG. 6.

First and second anti-friction radial vane guide assemblies 100 and 110 are shown in exploded fashion in FIG. 3, as a subassembly together with a vane 140 in FIG. 7, and as assembled in the complete unit AA in FIG. 1. The vane guide assemblies 100 and 110 are essentially identical to each other; for purposes of clarity, the vane guide assembly 100 is shown in enlarged detail in FIG. 3A which shows that this vane guide assembly comprises a first annular shaped ring 101 having a preselected outer diameter 101' and inner diameter 101" which further has, at the inboard axial end thereof, a radially inwardly-extending shoulder 101A. The vane guide assembly further includes a ball bearing member 105 having an outer race 105' an inner race 105" with a plurality of balls 105B positioned therebetween in conventional fashion. The outboard axial face 105A of the inner race 105" has a preselected diameter. Also, the inside diameter of the inner race 105" is preselected so as to be fitted onto the inner diameter 35ID of the annular recess 35 in the stator endplate means 25.

The vane guide assembly 100 further includes a washer-like shim 107 or axial adjustment means having an outer diameter 107', an inner diameter 107", an outboard axial face 107A, an inboard axial face 107B and a preselected axial thickness YY. As indicated, vane guide assembly 110 is generally identical to assembly 100; in FIG. 3 it is seen that the vane guide assembly 110 comprises an annular ring 111, a ball bearing assembly 115, and a washer-like shim 117 having a preselected axial thickness Y'Y'. As in the case of centering the rotor, in the limit, YY or Y'Y' can also be equal to zero.

Figure 6:
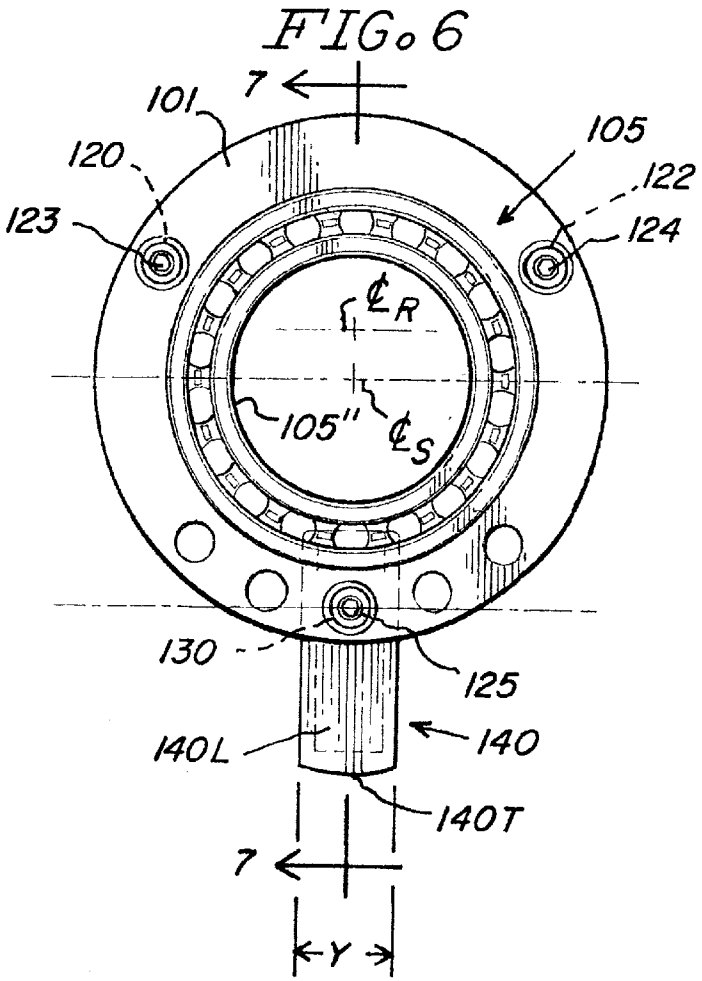
FIG. 6 is an end view, as viewed along section line 6—6 of FIG. 7, of an anti-friction radial vane guide assembly.

The two vane guide assemblies 100 and 110 are adapted to be connected together with the vane 140, to be described below, as a subassembly shown in FIG. 7; the assemblies are joined and connected together by three circumferentially spaced apart rods 120, 122 and 130. The rods 120 and 130 are shown as separate piece parts in FIG. 3, wherein it is noted that at each axial end thereof the rods have reduced sections with axially extended threaded bores therein for receiving the threaded ends of screws 123 and 125; shaft 122 being secured by screw means 124 (or any other means of attachment known in the art) shown in FIG. 6.

The subassembly of the vane guide assembly shown in FIG. 7 further depicts the bearing means 105 and 115 respectively positioned concentrically within the annular rings 101 and 111. FIG. 7 also shows that the assembled vane guide assemblies are concentric with the stator center line 12; the outboard axial faces 105A and 115A of the inner races of the bearing means 105 and 115 respectively are identified.

The vane 140 is connected to the shaft 130 as is clearly shown in FIG. 7. The vane 140 has a generally rectangular shape with a longitudinal or axial length 141 preselected to be essentially the same as the longitudinal length 93 of the rotor; vane 140 further has a angular thickness Y shown in FIG. 6 which is preselected so as to permit the vane to slidably fit within the rotor slot 95. The vane further has an outer tip surface 140T which is intended to harmonize with the continuous curved inner surface 14 of the stator 10 in accordance with the principles and teachings set forth in the above-mentioned prior art patents of the applicant. The vane 140 further has a pair of voids 142 and 142' which radially extend from the inboard or inner radial end of the vane outwardly, and are provided to reduce weight of the vane; the voids being spaced apart, for example, by an internal rib or wall 144. The vane 140 further has a pair of flat axial end surfaces 140L and 140R which, as is the case of the flat axial end surfaces 91 and 92 of the rotor 90 are intended to be in close abutting relationship with the flat surfaces 25AA and 45AA of the first and second stator end plate means 25 and 45 respectively. As explained above, the shims 80 and 80A provide a means of varying and equalizing the relative axial clearance or spacing between the surfaces 91 and 92 of the rotor with respect to the surfaces 25AA and 45AA. In somewhat similar fashion, but importantly independently of the rotor adjustment, the shims 107 and 117, by being preselected so as to have the desired axial thickness, provide a means of controlling and equalizing the gap or spacing of the flat axial end surfaces 140L and 140R of the vane 140 with respect to the aforesaid flat surfaces 25AA and 45AA of the stator endplate means. Thus, in assembly of the apparatus as shown in FIG. 1, the shims 80 and 80A on the one hand, as well as the shims 107 and 117 on the other hand, are preselected, each selection being independent of the other, so as provide substantially equal clearances between both axial ends of the rotor, and both axial ends of the vane with respect to the flat axial end surfaces 25AA and 45AA of the endplate means. Thus, the very important result of minimizing leakage is accomplished.

The stator housing 10 includes a gas inlet means 16 and a gas outlet means 17 positioned respectively on opposite sides of a plane P defined by the rotor and longitudinal axes 29 and 12, respectively; see FIG. 2.

The vane displacement apparatus AA further comprises means for rotating the assembled rotor and vane relative to the housing 10; this means is identified by reference numeral 150 in FIGS. 1 and 3. This means is depicted as an electric motor comprising a stator lamination stack 156 having a winding 157 adapted to be positioned within a annular recess 154 of a cup-type housing 151 closed off at the outboard axial end thereof by an end wall 152 having a centrally positioned cup 153 for receiving the outer race of a bearing 155, the inner race of which receives a hub 158' of a rotor 158 which, upon assembly, is in radial register with the stator laminations 156. The rotor 158 includes a central, axially extending bore 158" for receiving the end 70R of the rotor shaft 70 as is shown in FIG. 1. (Of course, the motor housing can be an integral part of endplate 46.)

An annular ring 160 has a preselected outer diameter 161 sized so as to fit snugly within an annular recess 151R of the housing 151. Thus, one axial end of ring 160 is abutted against a shoulder defined between annular surfaces 151R and 154 of the housing 151, and the other axial end is adapted to be positioned in an annular groove 45AA in the outboard axial end of stator endplate means 45, groove 45AA being concentric with the rotor axis 29. Thus, as shown in the full assembly drawing, FIG. 1, the motor means 150 is adapted to be energized by power through electrical lead means 157' and, when so energized, to drive the rotor about the rotor axis 29 at preselected speeds which are selected in accordance with the desired control function, changing from very slow to very high speeds.

In accordance with the teaching of the above-mentioned prior patents of the Applicant, the rotating rotor carries with it the single vane 140 with the rotor of course rotating about the rotor axis 29 and with the vane being carried by the vane guide assemblies so as to rotate about the stator axis 12, the vane tip surface 140 being adjacent to the inner surface 14 of the bore of the stator in a non-contacting but sealing relationship.

By proper careful preselection of the axial thickness YY and Y'Y' of the shims 107 and 117 of the vane guide assemblies, the clearance between vane axial end flat surface 140L and stator endplate flat surface 25AA can be made essentially identical to the clearance between flat surfaces 140R and 45AA.

Concurrently, but independently, the clearance between the two axial ends of the rotor and the surfaces 25AA and 45AA can be controlled to be essentially the same. More specifically, the axial thicknesses XX and X'X' of shims 80 and 80A are preselected during the assembly process so that the rotor flat axial end surfaces 91 and 92 have essentially the same axial clearance with respect to their matching or mating flat stator surfaces 25AA and 45AA. (Again, XX, X'X', YY and Y'Y' can selectively be zero.)

In summary, the present invention provides a solution to the problem of unequal axial gaps between the rotor and vane assembly, and the stationary housing end surfaces. It should be stressed that the present invention provides a means of adjusting the rotor independently of the adjustment for the vane. This is critically important as will be understood by those skilled in the art.

Alternate Rotor Centering Means

Figures 8, 9, 10, 11, 12:
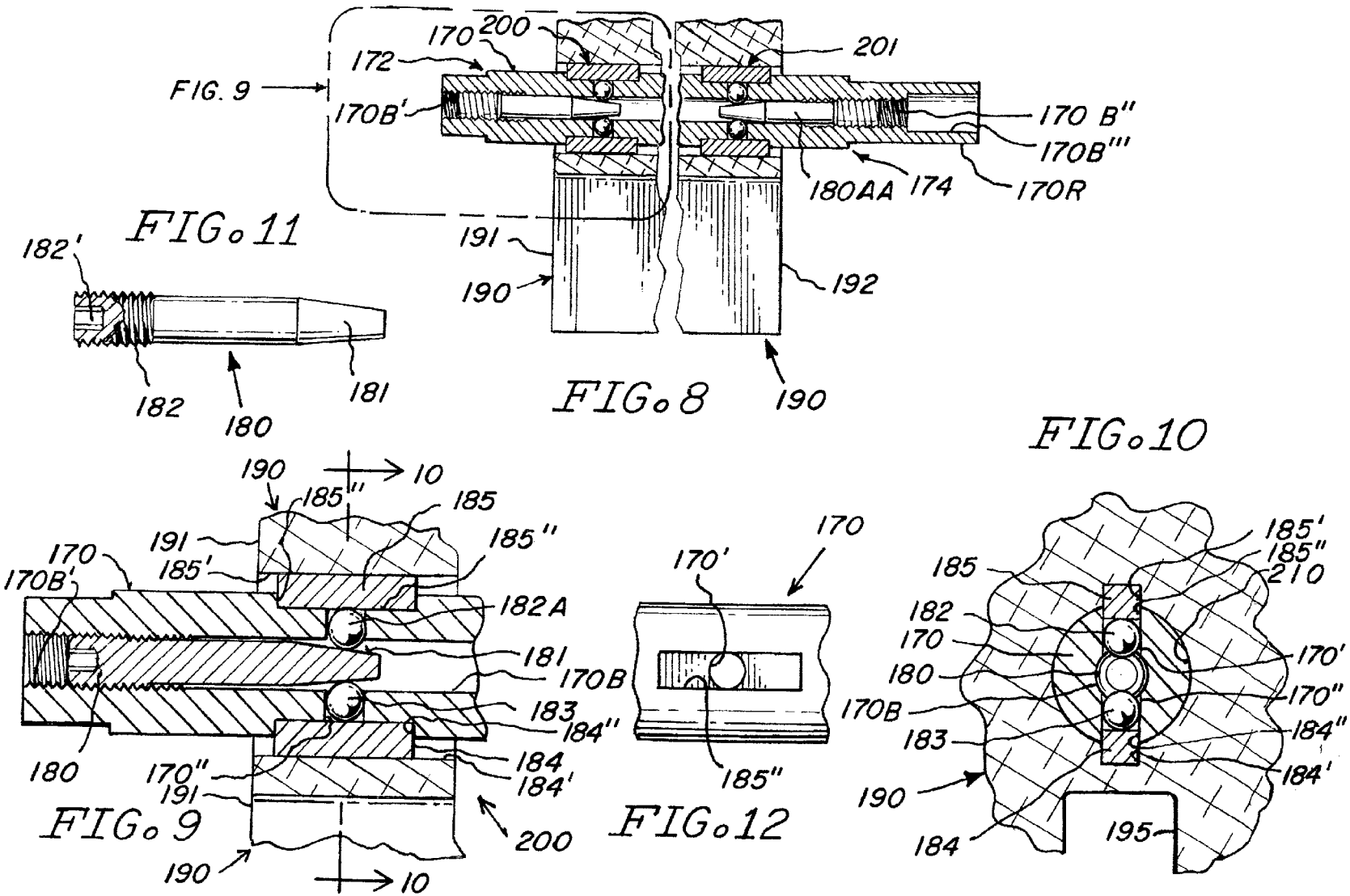
FIG. 8 shows an alternative means of accurately centering the rotor between stator endplates.
FIG. 9 is an enlarged view of a portion of the apparatus shown in FIG. 8.
FIG. 10 is a cross-sectional view of the apparatus as viewed along section lines 10—10 of FIG. 9.
FIG. 11 is a side view of an adjusting pin.
FIG. 12 is a side view of a portion of the rotor shaft 170 showing the keyway 185" and ballway 170'.

An alternate means for centering the rotor relative to the stator is depicted in FIGS. 8–12. Referring to FIG. 8, a rotor 190 having flat axial end surfaces 191 and 192 is mounted on a rotor shaft 170. The rotor shaft 170 has reduced portions 172 and 174 at its two ends thereof, similar in function to the reduced ends 72 and 74 of the rotor shaft shown in FIG. 5, the ends of the rotor shaft shown in FIG. 8 being sized so as to fit within the bearings 28 and 48 shown in FIG. 3. The shaft 170 has a central bore 170B throughout the axial ends of which are threaded as identified by reference numerals 170B' and 170B"; a further enlarged bore 170B'" being depicted at the right end of shaft 170 as shown in FIG. 8 so as to provide access to adjustment of a locking pin 180AA.

A pair of unique adjustment means 200 and 201 are shown in FIG. 8, adjustment means 200 being shown in enlarged detail in FIGS. 9–12, and it should be understood that adjustment means 201 is essentially identical to adjustment means 200 except being a mirror image thereof. Referring to FIG. 9, it is seen that adjustment means 200 comprises a pair of opposed elongated square cross-section keys 184 and 185; a pair of balls 182A and 183 for providing preselected radial force against the keys 184 and 185 respectively, and a pin 180 having a tapered nose or tip 181 for co-action with the balls 182A and 183. More specifically, keys 184 and 185 have a preselected axial length and radial thickness, and are positioned on opposite sides of the rotor shaft axis. Keys 184 and 185 sit respectively (i) in appropriate keyways 184' and 185' of the rotor 190, and (ii) in appropriate keyways 184" and 185" in the rotor shaft 170 as is clearly indicated in FIG. 10. It will be understood that the keys 184 and 185 may be adjusted axially with respect to the rotor.

The balls 182A and 183 are positioned in ballways 170' (see FIG. 12) and 170" for limited radial movement, said ballways immediately opening into the central bore 170B of the rotor shaft was is clearly shown in FIG. 9. The balls 182A and 183 are adapted to be abutted against the tapered nose 181 of the adjustment pin 180. Referring to FIG. 11, it will be noted that the pin 180 has at its outboard end a threaded means 182 for co-action with the threaded bore 170B' of the rotor shaft, and a tool-receiving means 182', at the outboard end, is provided for enabling the rotation of the pin 180 with respect to the shaft 170, it being understood that such rotation will either advance or retract the tapered surface 181 with respect to the balls 1 82A and 183. When the apparatus is being assembled and adjusted so as to provide an equal gap between rotor flat surfaces 191 and 192, and their respective adjacent stator flat surfaces; the pins 180 and 180AA are positioned so that the balls 182A and 183, and those of adjustment means 201, are not under compression. At this time there may be relative axial movement between the rotor and the rotor shaft. When the rotor has been positioned as desired on the rotor shaft, then the pins 180 and 180AA are advanced inwardly so that the tapered tips thereof bear against the balls to produce a radially outward force bearing against the keys 184 and 185 to lock the rotor shaft to the rotor.

The end 170R of the shaft shown in FIG. 8 has the enlarged access port or bore 170B'" to facilitate the use of an appropriate tool for rotating the pin 180AA with respect to the rotor shaft 170. Thus, the alternate arrangement shown in FIGS. 8–12 permits axial adjustment of the rotor on the rotor shaft to thereby equalize the air gaps between the rotor axial ends and the stationary flat surfaces of the stator end members to minimize leakage as aforesaid.

While the preferred embodiment of the invention has been illustrated, it will be understood that variations may be made by those skilled in the art without departing from the inventive concept. Accordingly, the invention is to be limited only by the scope of the following claims.

I claim:

1. A vane displacement apparatus comprising:

a) a stator housing having a right cylindrical bore therethrough, said bore having a preselected diameter, a preselected longitudinal axis and extent, and a generally continuous inner surface curved concentrically around said longitudinal axis;

b) first and second stator end plate means connectable to said housing at each end of said bore to define an enclosed right cylindrical space within said housing having a preselected longitudinal length, said first and second endplate means each having inwardly-facing flat surfaces normal to said longitudinal axis;

c) rotor shaft means eccentrically positioned in said bore and supported by bearing means in said end plate means for rotation about a rotor shaft axis parallel to but spaced a preselected distance from said longitudinal axis;

d) a right cylindrically-shaped rotor positioned in said bore, mounted on and connected to said rotor shaft means so as to rotate integrally therewith about said rotor shaft axis, said rotor having (i) two axial ends, each having flat surfaces normal to said rotor shaft axis, (ii) a longitudinal length preselected to be substantially the same as said preselected longitudinal extent of said enclosed space within said bore, and (iii) a radially extending slot having a preselected slot width and terminating at the outer periphery of said rotor, said slot at least in part also extending longitudinally between said two axial ends of said rotor;

e) first and second anti-friction radial vane guide assemblies, each assembly having a rotational axis and further comprising an outer race having a preselected diameter, an inner race concentrically and rotatably mounted within said outer race, said first and second assemblies being respectively mounted in said first and second end plate means with the rotational axes thereof being concentric with said preselected longitudinal axis of said stator housing;

f) attachment means connected to one of said races of said first and second vane guide assemblies;

g) a vane, at least a portion thereof having a generally rectangular shape with a longitudinal length preselected to be essentially the same as said longitudinal length of said rotor, a thickness preselected to permit said vane to slidably fit within said rotor slot and an outer tip surface, said vane being connected to said attachment means and being positioned within said rotor slot with said outer tip surface thereof being adjacent to said inner surface of said bore in a non-contacting but sealing relationship;

h) gas inlet mounting means and gas outlet mounting means on said housing, said gas inlet and outlet mounting means being respectively positioned on opposite sides of a plane defined by said rotor and longitudinal axes;

i) means for rotating said assembled rotor and vane relative to said housing; and j) means for axially adjusting said flat surfaces of said axial ends of said rotor relative to said flat surfaces of said stator endplate means to provide preselected sealing but non-contacting relationships between said stator endplate means and said axial ends of said rotor.

2. The vane displacement apparatus of claim 1, wherein (i) said bearing means supporting said rotor shaft means comprises a pair of ball bearings, each comprising an outer race positioned in one of said endplate means, and an inner race for receiving an end of said rotor shaft means, and (ii) said means for axially adjusting said flat surfaces of said axial ends of said rotor comprises washers of preselected axial thicknesses positioned between said rotor shaft and said inner race of each of said pair of ball bearings.

3. The vane displacement apparatus of claim 1, further characterized by including means for axially adjusting said vane with respect to said stator.

4. The vane displacement apparatus of claim 3, wherein said vane flat axial end surfaces are positioned substantially equidistant from said stator end plate means' inwardly facing flat surfaces.

5. The vane displacement apparatus of claim 3, wherein said means for axially adjusting said vane with respect to said stator comprises washers having preselected axial thickness, and sized in outer diameter to be substantially equal to said inner faces of said first and second vane guide assemblies, said washers being positioned between said stator endplate means and said inner races of said radial vane guide assemblies.

6. The vane displacement apparatus of claim 1, wherein said flat axial end surfaces of said rotor are positioned substantially equidistant from said inwardly facing flat surfaces of said stator endplate means.

7. The vane displacement apparatus of claim 6, wherein (i) said bearing means supporting said rotor shaft means comprises a pair of ball bearings, each comprising an outer race positioned in one of said endplate means, and an inner race for receiving an end of said rotor shaft means, and (ii) said means for axially adjusting said flat surfaces of said axial ends of said rotor comprises washers of preselected axial thicknesses positioned between said rotor shaft and said inner race of each of said pair of ball bearings.

8. Apparatus of claim 1, wherein said means for axial adjustment of said flat surfaces of said axial ends of said rotor comprises means for moving said rotor axially with respect to said rotor shaft to a preselected position whereat said rotor axial end surfaces are substantially equidistant from said stator endplate means inwardly-facing flat surfaces.

9. Apparatus of claim 8, wherein said means for axial adjustment comprises means for selectively locking said rotor to said rotor shaft against relative axial movement therebetween.

10. A vane displacement apparatus comprising:

a) a stator housing having a right cylindrical bore therethrough, said bore having a preselected diameter, a preselected longitudinal axis and extent, and a generally continuous inner surface curved concentrically around said longitudinal axis;

b) first and second stator end plate means connectable to said housing at each end of said bore to define an enclosed right cylindrical space within said housing having a preselected longitudinal length, said first and second endplate means each having inwardly-facing flat surfaces normal to said longitudinal axis;

c) rotor shaft means eccentrically positioned in said bore and supported by bearing means in said end plate means for rotation about a rotor shaft axis parallel to but spaced a preselected distance from said longitudinal axis;

d) a right cylindrically-shaped rotor positioned in said bore, mounted on and connected to said rotor shaft means so as to rotate integrally therewith about said rotor shaft axis, said rotor having (i) two axial ends, each having flat surfaces normal to said rotor shaft axis, (ii) a longitudinal length preselected to be substantially the same as said preselected longitudinal extent of said enclosed space within said bore, and (iii) a radially extending slot having a preselected slot width and terminating at the outer periphery of said rotor, said slot at least in part also extending longitudinally between said two axial ends of said rotor;

e) first and second anti-friction radial vane guide assemblies, each assembly having a rotational axis and further comprising an outer race having a preselected diameter, an inner race concentrically and rotatably mounted within said outer race, said first and second assemblies being respectively mounted in said first and second end plate means with the rotational axes thereof being concentric with said preselected longitudinal axis of said stator housing;

f) attachment means connected to one of said races of said first and second vane guide assemblies;

g) a vane, at least a portion thereof having a generally rectangular shape with a longitudinal length preselected to be essentially the same as said longitudinal length of said rotor, a thickness preselected to permit said vane to slidably fit within said rotor slot and an outer tip surface, said vane being connected to said attachment means and being positioned within said rotor slot with said outer tip surface thereof being adjacent to said inner surface of said bore in a non-contacting but sealing relationship;

h) gas inlet mounting means and gas outlet mounting means on said housing, said gas inlet and outlet mounting means being respectively positioned on opposite sides of a plane defined by said rotor and longitudinal axes;

i) means for rotating said assembled rotor and vane relative to said housing; and j) means for axially adjusting said flat axial end surfaces of said vane relative to said flat surfaces of said stator endplate means to provide preselected sealing but non-contacting relationships between said stator endplate means and said flat axial end surfaces of said vane.

11. The vane displacement apparatus of claim 10, wherein said vane flat axial end surfaces are positioned substantially equidistant from said stator end plate means' inwardly facing flat surfaces.

* * * * *